US010045119B2

(12) United States Patent
Matsuda et al.

(10) Patent No.: US 10,045,119 B2
(45) Date of Patent: Aug. 7, 2018

(54) ACOUSTIC STRUCTURE AND ACOUSTIC PANEL

(71) Applicant: Yamaha Corporation, Hamamatsu-shi, Shizuoka-ken (JP)

(72) Inventors: Hideto Matsuda, Hamamatsu (JP); Akira Miki, Hamamatsu (JP); Hirofumi Onitsuka, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 15/184,957

(22) Filed: Jun. 16, 2016

(65) Prior Publication Data

US 2016/0373855 A1 Dec. 22, 2016

(30) Foreign Application Priority Data

Jun. 18, 2015 (JP) ..... 2015-122987
Jun. 18, 2015 (JP) ..... 2015-123055

(51) Int. Cl.
*H04R 9/08* (2006.01)
*H04R 1/28* (2006.01)
*G10K 11/04* (2006.01)

(52) U.S. Cl.
CPC ..... *H04R 1/2857* (2013.01); *G10K 11/04* (2013.01); *H04R 1/2873* (2013.01); *H04R 1/2811* (2013.01); *H04R 1/2888* (2013.01)

(58) Field of Classification Search
CPC .. H04R 1/2857; H04R 1/2873; H04R 1/2811; H04R 1/2888; G10R 11/04
See application file for complete search history.

(56) References Cited

U.S. PATENT DOCUMENTS

| | | | | |
|---|---|---|---|---|
| 3,944,757 | A | 3/1976 | Tsukamoto | |
| 4,127,751 | A | 11/1978 | Kinoshita | |
| 4,930,596 | A | 6/1990 | Saiki et al. | |
| 2005/0190941 | A1* | 9/2005 | Yang | H04R 1/2819 381/351 |
| 2014/0254839 | A1 | 9/2014 | Shiozawa et al. | |

FOREIGN PATENT DOCUMENTS

| | | | |
|---|---|---|---|
| EP | 0 295 641 | A2 | 12/1988 |
| EP | 2 775 734 | A2 | 9/2014 |
| GB | 1 479 477 | A | 7/1977 |
| JP | S56-140799 | A | 11/1981 |
| JP | 2014-175807 | A | 9/2014 |

OTHER PUBLICATIONS

European Search Report dated Nov. 21, 2016, for EP Application No. 16173921.4, seven pages.

(Continued)

*Primary Examiner* — Tuan D Nguyen
(74) *Attorney, Agent, or Firm* — Morrison & Foerster LLP

(57) ABSTRACT

An acoustic structure defining a cavity in which a sound wave propagates, wherein a first portion of the cavity substantially corresponding to a position of a node or an antinode of a standing wave generated in the cavity has an area different from an area of a second portion of the cavity except the first portion, the area being on a plane orthogonal to a direction of propagation of the sound wave.

16 Claims, 14 Drawing Sheets

(56) References Cited

OTHER PUBLICATIONS

European Communication dated Jul. 19, 2017, for EP Application No. 16173921.4, four pages.
Bowers & Wilkins. (Apr. 21, 2015). "Nautilus Tapering Tubes: Not all sound generated by speaker drive units radiates into the room," located at: <http://www.bowers-wilkins.com/Discover/Discover/Technologies/Nautilus-Tapering-Tubes.html>, retrieved on Apr. 13, 2016, two pages.
Norh. (May 26, 2015). "Norh 3," Products, located at: <http://www.norh.com/Norh_Loudspeakers/Products.html>, retrieved on Feb. 18, 2016, one page.

* cited by examiner

ACOUSTIC STRUCTURE AND ACOUSTIC PANEL

CROSS REFERENCE TO RELATED APPLICATION

The present application claims priority from Japanese Patent Application Nos. 2015-122987 and 2015-123055, which were filed on Jun. 18, 2015, the disclosure of which is herein incorporated by reference in its entirety.

BACKGROUND

Technical Field

The following disclosure relates to an acoustic structure having a cavity in which sound waves propagate.

Description of Related Art

One example of the acoustic structure is a back chamber of a speaker. In an instance where a sound wave having a specific frequency propagates in the cavity of such an acoustic structure, there is generated a standing wave by superposition of the sound wave and reflected waves on a wall surface that defines the cavity, thereby causing a risk of a disturbance in frequency characteristics of the acoustic structure. In an instance where the frequency of the standing wave falls within a reproduction range of the speaker (i.e., a frequency range defined by the lower limit and the upper limit of frequencies of sounds represented by audio signals input to the speaker), peaks and dips in accordance with the frequency of the standing wave appear in the frequency characteristics of the speaker which should be flat. In view of this, there have been proposed various techniques of suppressing the disturbance in the frequency characteristics that arises from the standing wave. For instance, the following Non Patent Literatures 1 and 2, U.S. Pat. No. 4,127,751, and JP-56-140799A propose such techniques.

Non Patent Literatures 1 and 2 disclose an acoustic structure (as a back chamber of a speaker) in the form of a conical tapering tube, for suppressing reflection of the sound waves and accordingly suppressing generation of the standing wave. The acoustic structure is formed as the tapering tube for the purpose of avoiding generation of portions in the cavity at which acoustic impedance abruptly changes, in view of the fact that the reflection of the sound waves occurs at those portions at which acoustic impedance abruptly changes. U.S. Pat. No. 4,127,751, and JP-56-140799A propose a technique of suppressing generation of the standing wave by providing a sound absorber in the cavity of the acoustic structure.

Non Patent Literature 1: Bowers-Wilkins, retrieved on Apr. 21, 2015, [online], <URL:http://www.bowers-wilkins.jp/Discover/Discover/Technologies/nautilus-tapering-tubes.html>

Non Patent Literature 2: Norh, retrieved on May 26, 2015, [online], <URL:http://www.norh.com/Norh_Loudspeakers/Technlogy.html>

Patent Literature 1: U.S. Pat. No. 4,127,751

Patent Literature 2: JP-56-140799A

Patent Literature 3: JP-2014-175807A

SUMMARY

In the techniques disclosed in Non Patent Literatures 1 and 2, U.S. Pat. No. 4,127,751, and JP-56-140799A, there may be a risk that the frequency characteristics of the acoustic structure or the acoustic apparatus including the acoustic structure are influenced over a wide frequency range. Further, in the techniques disclosed in Non Patent Literatures 1 and 2, U.S. Pat. No. 4,127,751, and JP-56-140799A, it is difficult to control only propagation of a sound wave having a specific frequency, because sound waves in all frequencies that propagate in the cavity of the acoustic structure are influenced. In addition, the techniques disclosed in Non Patent Literatures 1 and 2 cannot suppress the standing wave that arises from the reflected waves on the wall surface, so that it is doubtful whether a sufficient effect is obtained. The techniques disclosed in U.S. Pat. No. 4,127,751 and JP-56-140799A suffer from an increase in the production cost of the acoustic structure (or the acoustic apparatus including the acoustic structure) due to provision of the sound absorber.

An aspect of the disclosure relates to a technique of controlling generation of a standing wave in an acoustic structure having a cavity in which sound waves propagate.

In one aspect of the disclosure, an acoustic structure defines a cavity in which a sound wave propagates, wherein a first portion of the cavity substantially corresponding to a position of a node or an antinode of a standing wave generated in the cavity has an area different from an area of a second portion of the cavity except the first portion, the area being on a plane orthogonal to a direction of propagation of the sound wave.

In an instance where the first portion of the cavity substantially corresponding to the position of the node of the standing wave (generated in the cavity when the area of the cavity is uniform) has an area on the plane smaller than an area of the second portion of the cavity substantially corresponding to other position on the plane, namely, in an instance where the acoustic structure has a tubular shape whose diameter is reduced at the position of the node, the resonance frequency corresponding to the standing wave is shifted toward a low frequency side. On the contrary, in an instance where the first portion of the cavity substantially corresponding to the position of the antinode of the standing wave has an area on the plane smaller than an area of the second portion of the cavity substantially corresponding to other position on the plane, namely, in an instance where the acoustic structure has a tubular shape whose diameter is reduced at the position of the antinode, the resonance frequency corresponding to the standing wave is slightly shifted toward a high frequency side. Further, in an instance where the first portion of the cavity substantially corresponding to the position of the antinode of the standing wave has an area on the plane larger than an area, on the plane, of the second portion of the cavity substantially corresponding to other position, namely, in an instance where the acoustic structure has a tubular shape whose diameter is increased at the position of the antinode, the resonance frequency corresponding to the standing wave is slightly shifted toward the low frequency side. In other words, the first portion of the cavity substantially corresponding to the position of the node or the antinode of the standing wave (generated in the cavity when the area of the cavity is uniform) has the area on the plane different from the area, on the plane, of the second portion substantially corresponding to other position of the standing wave, so that the frequency of the standing wave generated in the cavity can be controlled.

The acoustic structure constructed as described above may be shaped like a tube, and the plane orthogonal to the direction of propagation of the sound wave may be a plane orthogonal to a direction in which an axis of the tube extends, i.e., a length direction of the acoustic structure. This is in consideration of the fact that the standing wave generated in the direction of extension of the tube axis (which may be referred to as "tube axis direction") largely influences the frequency characteristics in the thus constructed acoustic structure.

In the acoustic structure constructed as described above, the area, on the plane, of the first portion of the cavity substantially corresponding to the position of the node of the standing wave may be smaller than the area of the second portion of the cavity on the plane.

In the acoustic structure constructed as described above, the acoustic structure may comprise an open tube communicating with the cavity via open ends of the open tube, and the open tube may have a tube length equal to an integral multiple of substantially a half wavelength of the standing wave, and the open ends of the open tube may be located at least one of a portion of the cavity substantially corresponding to the position of the antinode of the standing wave and a portion of the cavity substantially corresponding to the position of the node of the standing wave. Here, the first portion of the cavity substantially corresponding to the position of the node of the standing wave is a portion of the cavity defined as follows. In an instance where a position of one node of a sound pressure of the standing wave is defined as a reference position, the above-indicated first portion is a portion of the cavity corresponding to a range between: a position distant frontward from the reference position by a length corresponding to one-eighth (⅛) of the wavelength of the standing wave; and a position distant backward from the reference position by a length corresponding to one-eighth (⅛) of the wavelength of the standing wave. That is, the first portion is a portion of the cavity corresponding to a range over a length equal to a quarter (¼) of the wavelength of the standing wave, with the position of the node being at the center of the range. The applicant has confirmed by experiments that, as long as the first portion is within this range, it is possible to obtain the same effect as that obtained at a portion of the cavity corresponding to the position of the node of the standing wave. This is true of the first portion of the cavity substantially corresponding to the position of the antinode of the standing wave. Further, this is true of the tube length of the open tube which is equal to an integral multiple of substantially a half wavelength of the standing wave. Further, in an instance where the acoustic structure has the open tube described above, the above-indicated effect of controlling the frequency of the standing wave is combined with an effect of provision of the open tube, whereby a higher effect is ensured. Concerning the effect of provision of the open tube, refer to JP-2014-175807A. The disclosure of JP-2014-175807A is herein incorporated by reference in its entirety.

The acoustic structure constructed as described above may comprise a plurality of open tubes each as the open tube, and the plurality of open tubes may have mutually different tube lengths. According to the acoustic structure, the effect of provision of the open tube is ensured for various resonance frequencies. In this respect, at least two of the plurality of open tubes may have mutually the same tube length. In this arrangement, the resonance frequency is more noticeably shifted toward the lower or the higher frequency side. The acoustic structure constructed as described above may comprise at least one sound absorber that fills at least one of: a space in the open tube; and a space in the cavity, for enhancing the effect of provision of the open tube. In the acoustic structure constructed as described above, the open tube may be bent at least once, for making the acoustic structure compact in size.

In another aspect of the disclosure, in an acoustic structure defining a cavity in which a sound wave propagates, an intermediate portion of the cavity located intermediate between opposite end portions of the cavity in a direction of propagation of the sound wave may have an area different from an area of each of two portions ranging from the respective opposite ends portions to the intermediate portion, the area being on a plane orthogonal to a direction of propagation of the sound wave. Also in the thus constructed acoustic structure, the frequency of the standing wave generated in the cavity is controllable.

In still another aspect of the disclosure, in an acoustic panel including a plurality of acoustic structures arranged alongside with each other, each of the acoustic structures may define a cavity in which a sound wave propagates, an intermediate portion of the cavity located intermediate between opposite end portions of the cavity in a direction of propagation of the sound wave may have an area different from an area of each of two portions ranging from the respective opposite end portions to the intermediate portion, the area being on a plane orthogonal to a direction of propagation of the sound wave, and each of the acoustic structures may have, on a side surface thereof, an opening through which the cavity communicates with an exterior of the acoustic structure.

In yet another aspect of the disclosure, an acoustic apparatus includes: a cabinet; and a speaker mounted on a front surface of the cabinet and including (a) a driver configured to generate acoustic vibration based on audio signals and (b) an acoustic structure having a first end that is open toward a backside of the driver and a second end that is closed, wherein the acoustic structure may define a cavity in which a sound wave propagates, and wherein a first portion of the cavity substantially corresponding to a position of a node or an antinode of a standing wave generated in the cavity may have an area different from an area of a second portion of the cavity except the first portion, the area being on a plane orthogonal to a direction of propagation of the sound wave. Also in the thus constructed acoustic structure, the frequency of the standing wave generated in the cavity is controllable.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF EMBODIMENTS

Figure 1A:
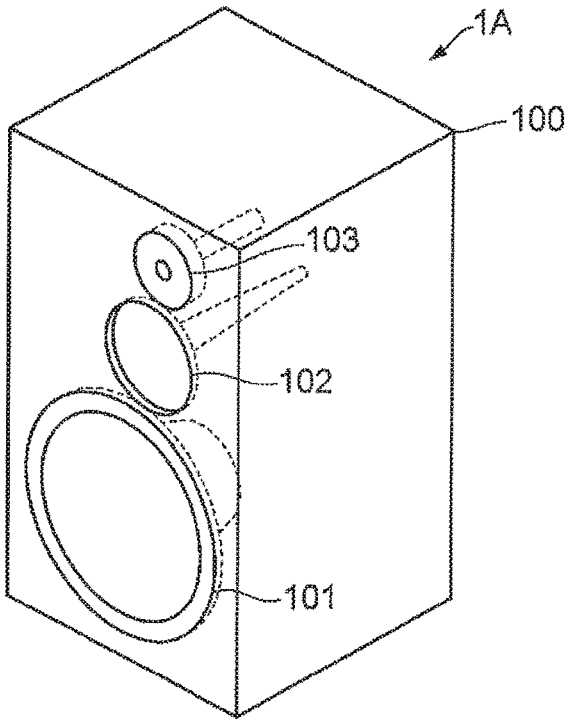
FIGS. 1A and 1B are views of an acoustic structure 20A according to a first embodiment and an acoustic apparatus 1A including the acoustic structure 20A.

There will be hereinafter explained embodiments referring to the drawings.

First Embodiment

FIG. 1A is a perspective view of an acoustic apparatus 1A including an acoustic structure 20A according to a first embodiment. The acoustic apparatus 1A is a three-way speaker constituted by a woofer 101, a squawker 102, and a tweeter 103 mounted on a front surface of a cabinet 100. To the three speakers, i.e., the woofer 101, the squawker 102, and the tweeter 103, of the acoustic apparatus 1A, audio signals in frequency ranges respectively unique to the three speakers are input. When focusing on the center frequency of the frequency range of the audio signals input to each of the three speakers, the center frequency for the woofer 101 is the lowest, and the center frequency for the tweeter 103 is the highest. A reproduction range for the woofer 101 and a reproduction rage for the squawker 102 may or may not partly overlap. Similarly, a reproduction range for the tweeter 103 and the reproduction rage for the squawker 102 may or may not partly overlap. In the present embodiment, the squawker 102 includes the acoustic structure 20A. Hereinafter, the squawker 102 will be explained in detail.

Figure 1B:
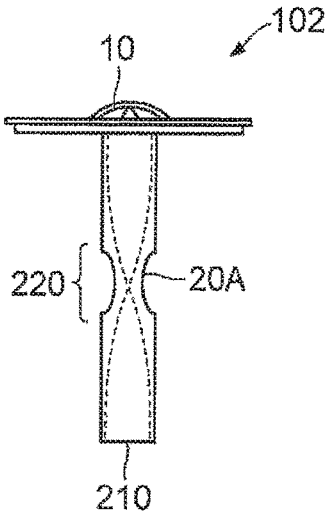

FIG. 1B is a view of the squawker 102. As shown in FIG. 1B, the squawker 102 includes a driver 10 and the acoustic structure 20A. The driver 10 is a vibrating portion configured to generate an acoustic vibration based on audio signals given from an amplifier not shown. The acoustic structure 20A is the so-called back chamber and is a hollow member having a generally tubular shape. One end portion of the acoustic structure 20A is an open end that is open toward the backside of the driver 10 while the other end portion 210 of the acoustic structure 20A is a closed end. That is, the acoustic structure 20A is a one-end closed tube. In the present embodiment, however, the acoustic structure 20A is disposed such that its open end is connected to the backside of the driver 10, so that a both-end closed tube is defined by the backside of the driver 10 and the acoustic structure 20A.

As shown in FIG. 1B, the acoustic structure 20A is narrowed in the vicinity of its central portion in a tube axis direction (i.e., a propagation direction of sound waves generated by the driver 10) so as to have an inner diameter smaller than other portion. That is, when focusing on an inner cavity of the acoustic structure 20A of the present embodiment, a portion of the cavity in the vicinity of the central portion in the tube axis direction, as one example of a first portion of the cavity, has a cross-sectional area on a plane perpendicular to the tube axis (i.e., an area of the portion of the cavity in the vicinity of the central portion in the tube axis direction on the plane) smaller than a cross-sectional area of other portion of the cavity on the plane, as one example of the second portion of the cavity, (i.e., an area of the other portions of the cavity on the plane except the portion in the vicinity of the central portion). In the present embodiment, the portion of the acoustic structure 20A in the vicinity of the central portion, namely, the portion having the smaller diameter, is referred to as a narrowed portion 220. The present embodiment is characterized by provision of the narrowed portion 220.

Without the narrowed portion 220, the acoustic structure 20A is a one-end closed tube having a substantially constant inner diameter, and a both-end closed tube having the substantially constant inner diameter is defined by the backside of the driver 10 and the acoustic structure 20A. In this case, sound waves generated by the vibration of the driver 10 propagate in the cavity of the acoustic structure 20A in the tube axis direction, and resonance, i.e., a standing wave, is generated at a frequency in accordance with the tube length of the acoustic structure 20A. In the following description, a standing wave whose wavelength is the n-th longest is referred to as "n-th-order standing wave" (in which "n" represents a natural number not smaller than 1). The first-order standing wave is a standing wave whose wavelength is substantially twice the tube length of the acoustic structure 20A. In the first-order standing wave, the sound pressure does not almost vary in the vicinity of the central portion of the acoustic structure 20A, and the first-order standing wave becomes a node in the vicinity of the central portion. In FIG. 1B, the first-order standing wave generated in the inner cavity of the acoustic structure 20A without the narrowed portion 220 is expressed by the broken line. In the following description, the frequency of the n-th-order standing wave is referred to as "nth-order resonance frequency".

The inventors of the present application have considered that, by providing a narrowed portion in an acoustic structure shaped like a both-end closed tube having a constant inner diameter, the resonance phenomenon that occurs in the cavity of the acoustic structure changes from the so-called tube resonance and resembles Helmholtz resonance in behavior (this phenomenon is hereinafter referred to as "change to Helmholtz resonance"), so that the resonance frequency can be controlled. Further, the inventors have confirmed by simulations that the resonance frequency can be actually controlled. The acoustic structure 20A of the present embodiment is based on the findings. Hereinafter, the simulations conducted by the inventors will be explained in detail.

Figure 2A:
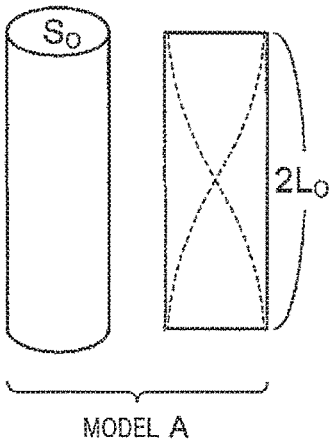
FIGS. 2A and 2B are views of models for examining a resonance phenomenon that occurs in an inner cavity of the acoustic structure 20A.
Figure 2B:
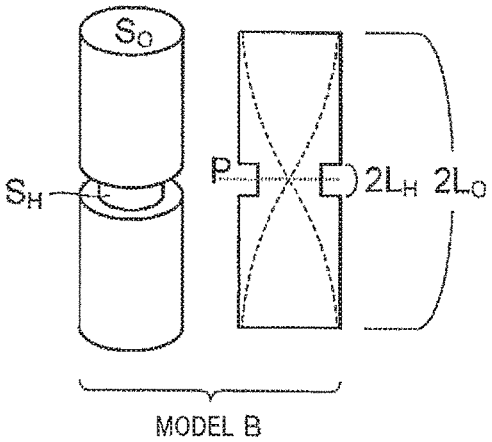

FIG. 2A schematically shows a model ("model A") corresponding to the acoustic structure shaped like the both-end closed tube. FIG. 2B schematically shows a model ("model B") corresponding to the acoustic structure having the narrowed portion. As shown in FIG. 2A, the model A is the both-end closed tube having a tube length 2L0. In the model A, the cross section of the cavity on the plane perpendicular to the tube axis is a circle having an area S0 (as one example of a second area) at any position in the tube axis direction. In contrast, the model B has a shape obtained by narrowing a portion in the vicinity of the central portion of the model A over a distance 2LH, and the narrowed portion (as one example of a first portion of the cavity) is the narrowed portion 220. That is, in the model B, the narrowed portion is provided at a position of a node of the first-order standing wave that is generated in an instance where the narrowed portion is not provided, namely, in an instance where the inner diameter of the tube is constant. The position of the node corresponds to the vicinity of the central portion in the tube axis direction. In the model B, the cross section of the cavity at the narrowed portion is a circle having an area SH (S0>SH). The area SH is one example of a first area.

A first-order resonance frequency ft for the model A is represented by the following expression (1) in which "c" represents a sound velocity. (This is true of other expressions.)

$$f_t = \frac{c}{4L_0} \tag{1}$$

The model B may be regarded as being formed by two Helmholtz resonators that face each other on a plane P indicated by the dotted line in FIG. 2B, each Helmholtz resonator having a neck length LH and a volume V=S0×(L0−LH). In this case, a resonance frequency fH for the model B is represented by the following expression (2) based on the theoretical equation of the Helmholtz resonance. In the expression (2), "π" represents the circular constant, and "LH'" means the neck length value LH including a tube open end correction. (This is true of other expressions.)

$$f_H = \frac{c}{2\pi}\sqrt{\frac{S_H}{VL'_H}} \tag{2}$$

Here, there is studied a condition that satisfies ft>fH, namely, a condition under which the first-order resonance frequency is shifted toward the lower frequency side by the change from the tube resonance to the Helmholtz resonance. By substituting the expression (1) into the left-hand side of ft>fH and substituting the expression (2) into the right-hand side of ft>fH and by removing the radical sign, the following expression (3) is obtained. Here, "aH" in the left-hand side of the expression (3) represents a radius of the narrowed portion 220 (i.e., $\pi aH^2$=SH) and "a0" in the left-hand side of the expression (3) represents a radius of other portion except the narrowed portion 220 (i.e., $\pi a0^2$=S0).

$$\left(\frac{a_H}{a_0}\right)^2 < \frac{\pi^2}{4}\left(1 - \frac{L_H}{L_0}\right)\frac{L'_H}{L_0} \tag{3}$$

In an instance where the two Helmholtz resonators face each other as shown in FIG. 2B, it is not clear what value "LH'" becomes. Therefore, the following study is made in a case under the most strict condition, namely, in a case in which LH'=LH. In an instance where aH/a0 and LH/L0 are equal, the expression (3) always holds if the following expression 4 is satisfied when aH/a0=LH/L0=t. Here, "d" in the expression (4) is a value indicated in the following expression (5). Further, irrespective of whether or not aH/a0 and LH/L0 are equal, the expression (3) holds when 0<aH/a0<f (see expression (6)) if LH/L0=½, and the expression (3) holds when 0<aH/a0<d (see expression 5) if e (see expression 7) <LH/L0<d.

$$0 < t < d \tag{4}$$

$$d = \frac{\pi^2}{\pi^2 + 4} \tag{5}$$

$$f = \frac{\pi}{4} \tag{6}$$

$$e = \frac{4}{\pi^2 + 4} \tag{7}$$

The condition indicated by the expression (3) is more generally studied as follows. "LH'" which is the neck length value LH including the open end correction is generally represented by the following expression (8). "x" in the right-hand side of the expression (8) is a parameter indicative of the open end correction and is equal to 1.7 (x=1.7) when there exists a baffle surface. By substituting the expression (8) into the right-hand side of the expression (3) and replacing with the following equations aH/a0=t, LH/L0=r, and u=x(aH/L0), the expression (3) is rewritten into the following expression (9):

$$L'_H = L_H + xa_H \tag{8}$$

$$t^2 < \frac{\pi^2}{4}\left\{-\left(r - \frac{1-u}{2}\right)^2 + \left(\frac{1+u}{2}\right)^2\right\} \tag{9}$$

Here, a study is made for a case in which t≈1 and r≈0, namely, a case in which aH≈a0 and LH≈0, in other words, a case in which the narrowed portion 220 is formed by narrowing a portion in the vicinity of a center portion of a straight pipe. By substituting t=1 and r=0 into the expression (9) and rewriting the expression (9) in consideration of u=x(aH/L0), the following expression (10) is obtained, and the expression (3) holds if the expression (10) holds. The left-hand side in the expression (10) represents a ratio of the tube radius a0 to the tube length L0. As apparent from the expression (10), it is understood that, if the ratio of the tube radius a0 to the tube length L0 is larger than a certain value (i.e., a value of the right-hand side in the expression (10)), the condition indicated by the expression (3) is satisfied, namely, the resonance frequency can be shifted toward the low frequency side owing to the change to the Helmholtz resonance, by slightly narrowing the central portion of the tube so as to form the narrowed portion 220.

$$\frac{a_0}{L_0} > \frac{4}{\pi^2 x} \tag{10}$$

Figure 3:
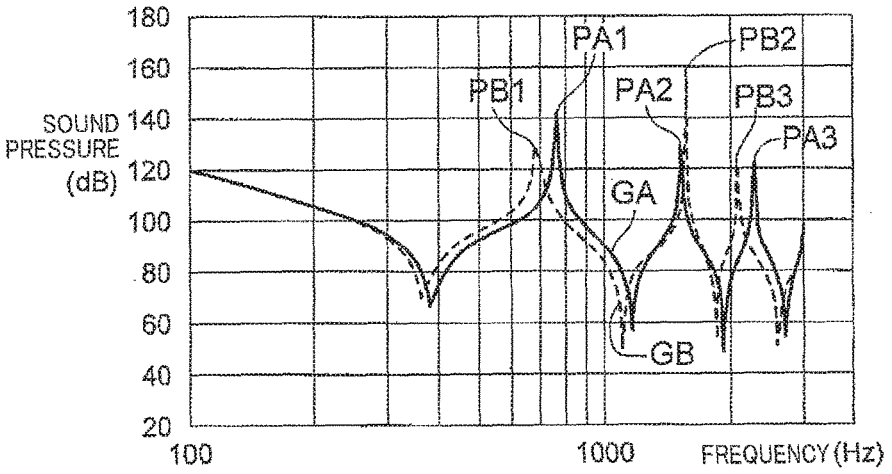
FIG. 3 is a view showing simulation results for the models of FIG. 2.

FIG. 3 is a view showing simulation results of the frequency characteristics for the model A and the model B in which L0 and a0 are determined such that ft=760 Hz and such that the expression (10) is satisfied. In the simulations, the model A and the model B have a tube length (i.e., 2×L0)

of 224 mm. In the model B, the narrowed portion 220 has a length in the tube axis direction (i.e., 2×LH) of 10 mm. In FIG. 3, a graph curve GA indicates the frequency characteristics of the model A, and a graph curve GB indicates the frequency characteristics of the model B. As apparent from FIG. 3, there appear, in the graph curve GA, a peak PA1 around 760 Hz corresponding to the first-order resonance frequency of the model A, a peak PA2 around 1520 Hz corresponding to the second-order resonance frequency of the model A, and a peak PA3 around 2280 Hz corresponding to the third-order resonance frequency of the model A. In the graph curve GB, in contrast, a peak PB1 corresponding to the peak PA1 and a peak PB3 corresponding to the peak PA3 are both shifted toward the low frequency side, and the peak values of the peaks PB1 and PB3 are both lowered. Further, a peak PB2 corresponding to the peak PA2 is slightly shifted toward the high frequency side, and the peak value of the peak PB2 is slightly increased.

Among the resonance phenomena that occur in the acoustic apparatus, the first-order resonance phenomenon often gives the largest influence on the frequency characteristics of the acoustic apparatus. As apparent from the simulation results, the acoustic structure in the form of the both-end closed tube is formed so as to satisfy the condition indicated by the expression (10) and the narrowed portion is provided at the position of the node of the first-order standing wave, in other words, at the first portion of the cavity substantially corresponding to the position of the node, whereby the first-order resonance frequency can be shifted to the lower frequency side and the peak values thereof can be lowered. It is expected that the disturbance in the frequency characteristics arising from the first-order resonance phenomenon can be mitigated based on the effect. In the simulation results, a change similar to that in the first-order resonance frequency occurs also in the third-order resonance frequency. This is because the position of the node in the first-order standing wave is also the position of the node in the third-order standing wave, and it seems that the change is due to the change to the Helmholtz resonance as in the first-order resonance phenomenon.

A change different from that in the first-order resonance phenomenon occurs in the second-order resonance phenomenon because the position of the node in the first-order standing wave is the position of the antinode in the second-order standing wave. In view of the fact that the resonance frequency is shifted toward the high frequency side, it is considered that provision of the narrowed portion 220 at the position of the antinode of the standing wave, in other words, at the first portion of the cavity substantially corresponding to the position of the antinode, corresponds to shortening the tube length. Since the change is due to the change in the tube length, it seems that the shift amount is smaller, as compared with the shift amount due to the change to the Helmholtz resonance. As apparent from a comparison between the shift amount of the first-order resonance frequency and the shift amount of the second-order resonance frequency, the influence on the second-order resonance frequency by provision of the narrowed portion 220 at the position of the node in the first-order standing wave is almost negligible.

Figure 4:
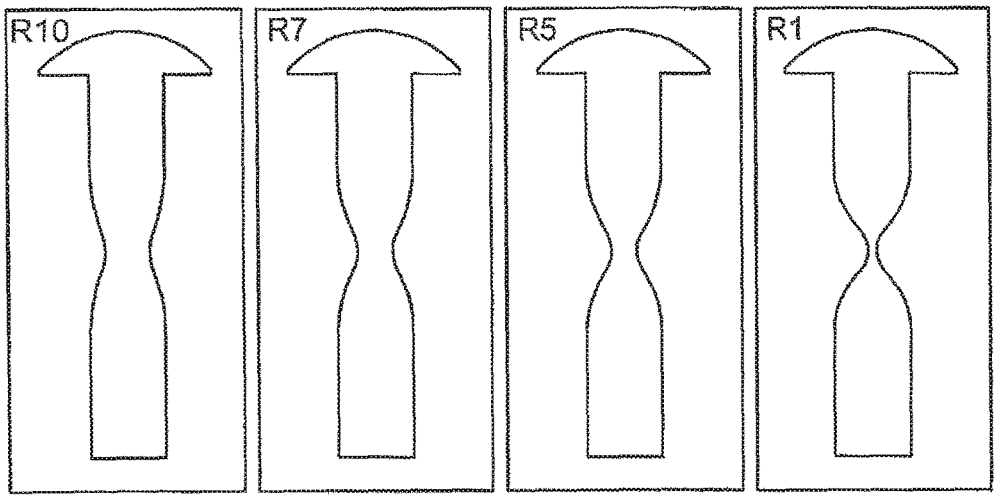
FIG. 4 is a view for explaining a relationship between: a shift amount and a peak value of a resonance frequency; and an inner diameter of a narrowed portion.
Figure 5:
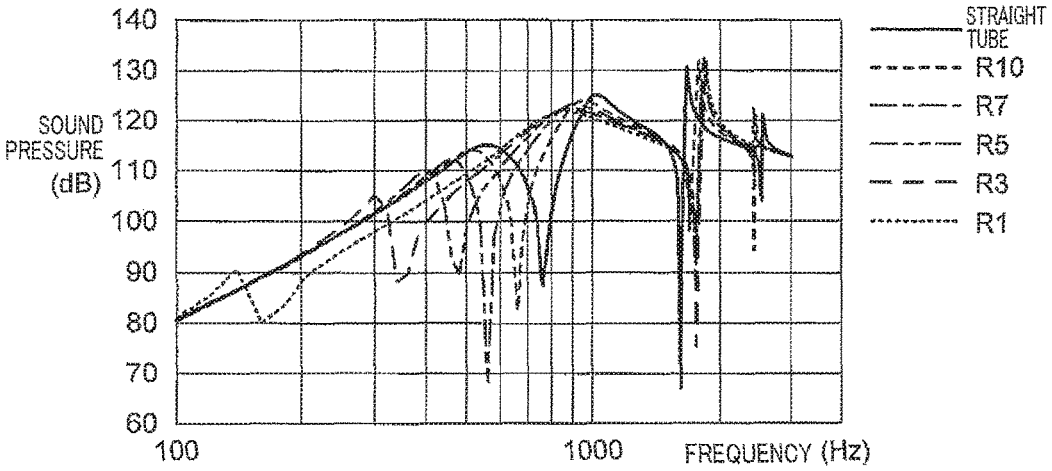
FIG. 5 is a view for explaining a relationship between: a shift amount and a peak value of a resonance frequency; and an inner diameter of a narrowed portion.

To confirm influences of a degree of a size reduction of the narrowed portion 220 on the shift amount and the peak-value change amount of the first-order resonance frequency, the inventors have conducted simulations relating to the frequency characteristics using a plurality of models having mutually different cross-sectional areas and examined a relationship between: the cross-sectional area of the narrowed portion; and the shift amount of the first-order resonance frequency toward the low frequency side and the peak value of the first-order resonance frequency. The plurality of models used in the simulation are models R10, R7, R5, R3, and R1 whose cross-sectional areas become smaller in the order of description. (In FIG. 4, the models R10, R7, R5, and R1 are illustrated.) The simulations use the models which are modeled including a space on the rear side of a diaphragm in the driver 10 (i.e., a semicircular space shown in FIG. 4). The space is smaller than the back chamber, and the simulation results do not almost change depending upon whether the space is present or not. FIG. 5 is a view indicating the frequency characteristics obtained by the simulation. As shown in FIG. 5, the shift amount becomes larger and the peak value becomes lower with a decrease in the cross-sectional area of the narrowed portion 220.

Figure 6:
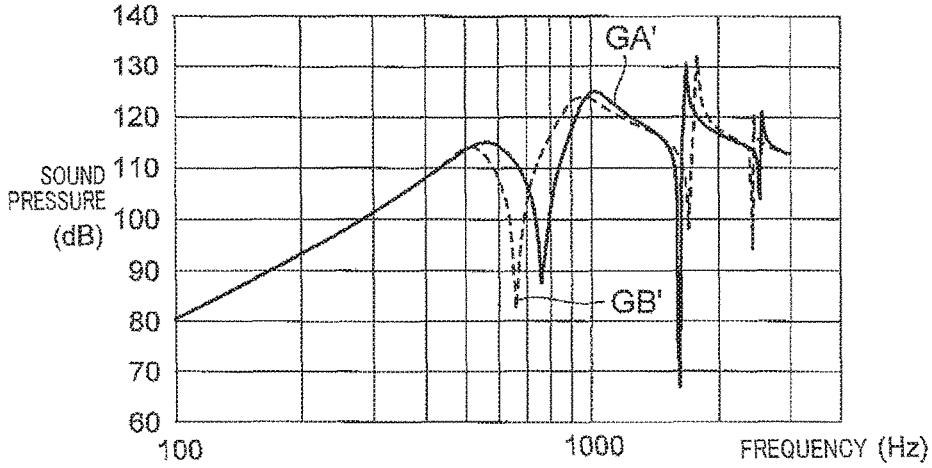
FIG. 6 is a view showing simulation results for frequency characteristics of the acoustic structure 20A.

The acoustic structure 20A according to the present embodiment is constituted based on the simulation results described above. FIG. 6 is a view showing simulation results of the frequency characteristics for the acoustic structure 20A in an instance in which the acoustic structure 20A does not have the narrowed portion 220 and the acoustic structure 20A is designed such that the first-order resonance frequency is equal to 1 kHz. A graph curve GA' in FIG. 6 indicates the frequency characteristics in the instance in which the acoustic structure 20A does not have the narrowed portion 220, and a graph curve GB' indicates the frequency characteristics of the acoustic structure 20A. As apparent from FIG. 6, it is understood that, owing to provision of the narrowed portion 220, the resonance frequency of each order is shifted and the peak value in the resonance frequency of each order is changed, as in the model B. Consequently, when the frequency characteristics of the squawker 102 are suffering from a disturbance due to the first-order standing wave, it is possible to avoid the disturbance in the frequency characteristics from becoming conspicuous in audibility, by adjusting the cross-sectional area of the cavity at the narrowed portion 220 such that the first-order resonance frequency is shifted toward the low frequency side that is lower than the lower limit of the frequency range for the squawker 102.

Figure 7A:
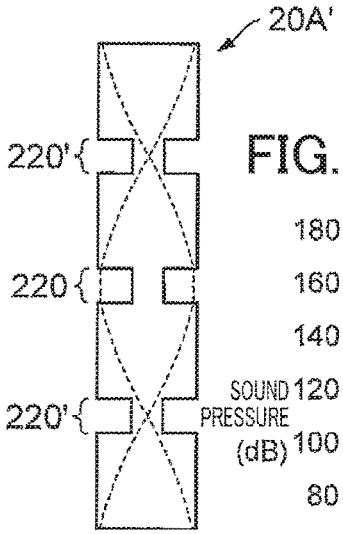
FIGS. 7A and 7B are views for explaining one example of the acoustic structure 20A.
Figure 7B:
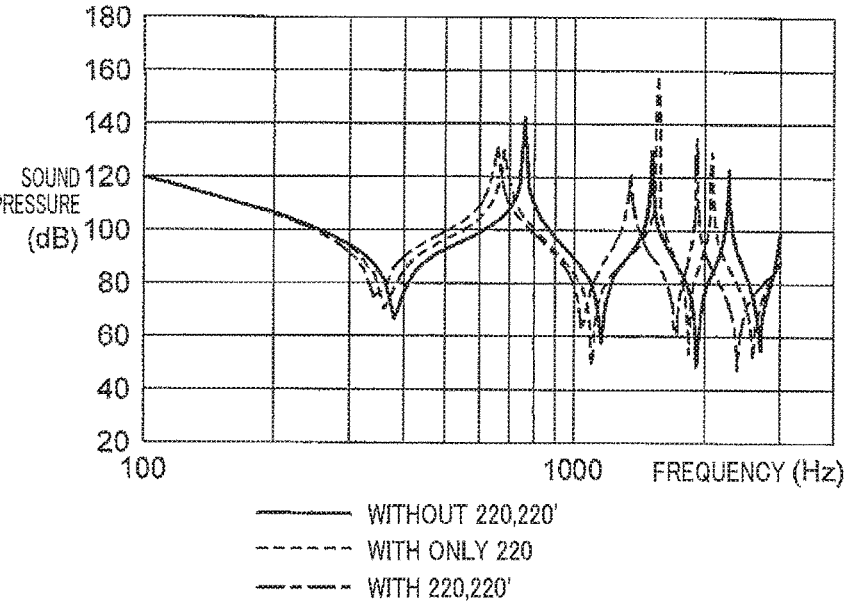

The present embodiment has been explained for the case in which the first-order resonance frequency is shifted toward the lower frequency side, wherein the first-order resonance frequency is generated in the cavity of the acoustic structure 20A without the narrowed portion 220, namely, in the cavity of the acoustic structure shaped like the one-end closed tube and constituting the both-end closed tube with the backside of the driver 10. For shifting the second-order resonance frequency with the first-order resonance frequency, the narrowed portions 220' (FIG. 7A) are additionally provided such that each narrowed portion 220' is located at a position of a node of the second-order standing wave, namely, at a position away from a corresponding one of opposite ends of the acoustic structure by a distance corresponding to a quarter of the length of the acoustic structure. In FIG. 7A, the second-order standing wave in an instance where the narrowed portions 220, 220' are not provided is indicated by the dotted line. The second-order resonance frequency is shifted toward the low frequency side as shown in FIG. 7B, by providing the narrowed portions 220' in addition to the narrowed portion 220.

According to the present embodiment, the disturbance in the frequency characteristics arising from the standing wave having a specific frequency is mitigated while preventing the frequency characteristics from being influenced over all frequency ranges of the acoustic apparatus 1 having the acoustic structure 20A. Moreover, the present embodiment does not additionally require sound absorbers or the like, avoiding an increase in the manufacture cost of the acoustic structure 20A (the squawker 102) or the acoustic apparatus including the acoustic structure 20A (the acoustic apparatus 1 including the squawker 102). While the principle of the invention is applied to the back chamber of the squawker 102 in the present embodiment, the principle of the invention is applicable to a back chamber of the woofer 101 or the tweeter 103. This is true of the following second and third embodiments.

Second Embodiment

Figure 8A:
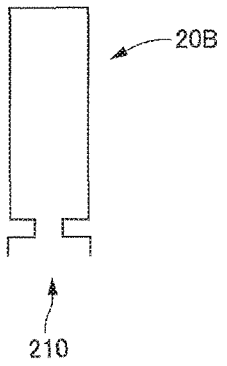
FIG. 8A is a view of an acoustic structure according to a second embodiment and FIG. 8B is a view showing simulation results for frequency characteristics of the acoustic structure.

FIG. 8A shows an acoustic structure 20B according to a second embodiment. Like the acoustic structure 20A, the acoustic structure 20B is a back chamber in the squawker or the like. However, the acoustic structure 20B differs from the acoustic structure 20A in that one end portion 210 opposite to another end portion facing the driver 10 is an open end. Since the end portion 210 remote from the driver 10 is an open end, a one-end closed tube is constituted by the backside of the driver 10 and the acoustic structure 20B if the acoustic structure 20A of the squawker 102 in the first embodiment is replaced with the acoustic structure of this embodiment.

Figure 8B:
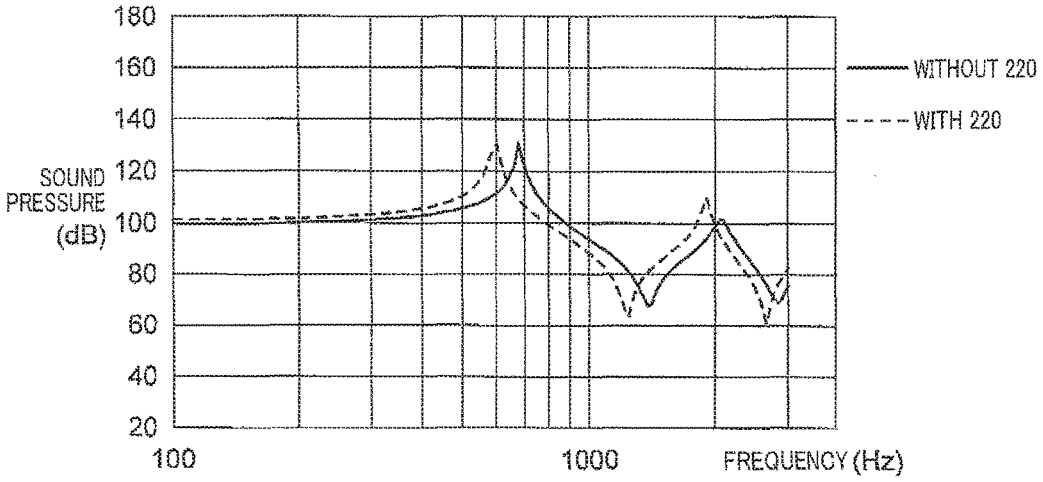
Figure 9A:
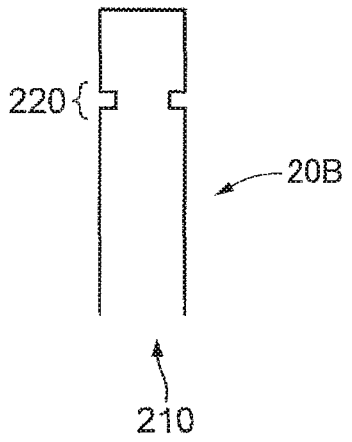
FIG. 9A is a view of one example of the acoustic structure of the second embodiment and FIG. 9B is a view showing simulation results for frequency characteristics of the acoustic structure.
Figure 9B:
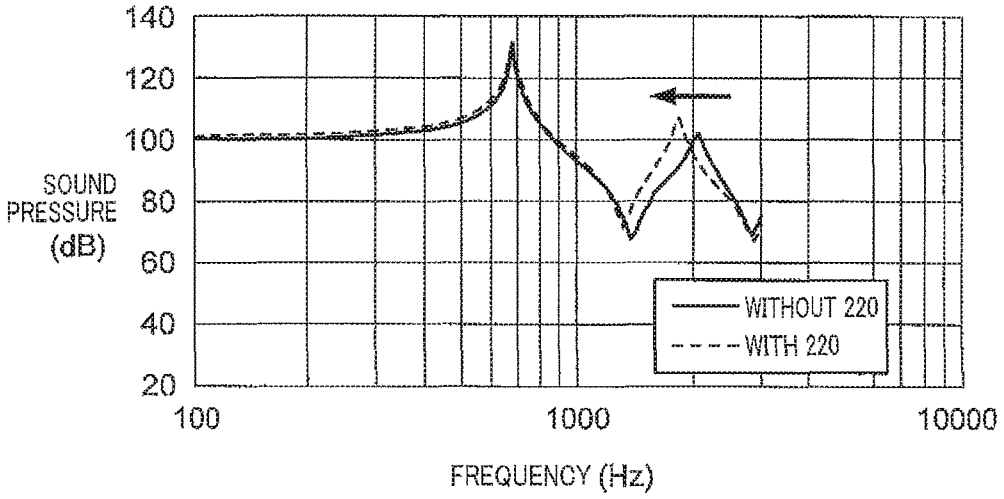

In the first-order standing wave generated in the inner cavity of the acoustic structure in the form of the one-end closed tube without the narrowed portion 220, the position of the node is near the open end of the acoustic structure. In the second-order standing wave similarly generated, the position of the node is away from the open end toward the closed end by a distance corresponding to a half wavelength. The inventors have confirmed by simulations that, by providing the narrowed portion at the position of the node of the standing wave, the resonance frequency corresponding to the standing wave is shifted toward the low frequency side in the acoustic structure shaped like the one-end closed tube. FIG. 8A shows the acoustic structure 20B of the second embodiment, and FIG. 8B shows simulation results of the frequency characteristics of the acoustic structure 20B shaped like the one-end closed tube, namely, simulation results of the frequency characteristics in a case in which the narrowed portion 220 is provided at the position of the acoustic structure 20B shaped like the one-end closed tube corresponding to the node of the first-order standing wave (i.e., the position near the open end of the acoustic structure). As apparent from FIGS. 8A and 8B, the first-order resonance frequency is shifted toward the low frequency side by providing the narrowed portion 220 at the position of the acoustic structure shaped like the one-end closed tube corresponding to the node of the first-order standing wave. Similarly, for shifting the second-order resonance frequency toward the low frequency side, the narrowed portion 220 is provided at a position away from the end portion 210 of the acoustic structure 20B toward the backside of the driver 10 by a distance corresponding to a half wavelength (i.e., a distance corresponding to two-thirds (⅔) of the length of the acoustic structure), as shown in FIG. 9A. Thus, the second-order resonance frequency is shifted toward the low frequency side, as shown in FIG. 9B.

Also in this embodiment, the disturbance in the frequency characteristics arising from the standing wave having a specific frequency is mitigated while preventing the frequency characteristics from being influenced over all frequency ranges of the acoustic apparatus having the acoustic structure in the form of the back chamber or the like. Moreover, this embodiment does not additionally require sound absorbers or the like, avoiding an increase in the manufacture cost of the acoustic structure or the acoustic apparatus including the acoustic structure.

Third Embodiment

Figure 10:
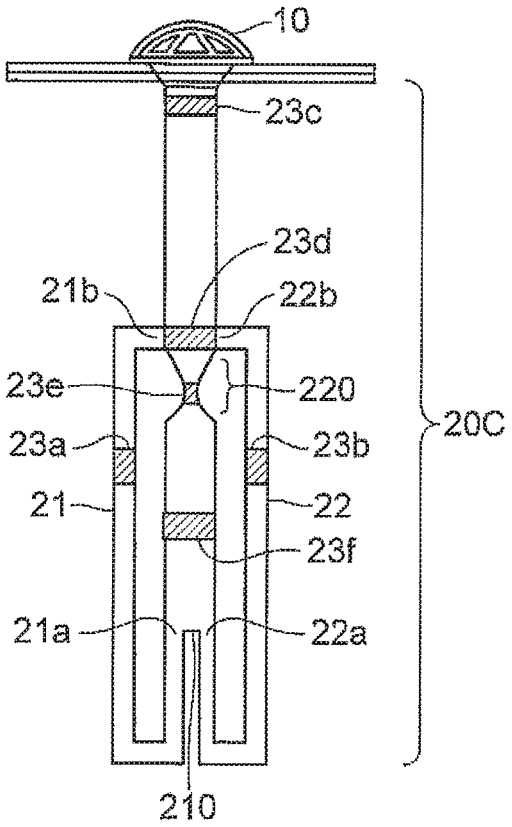
FIG. 10 is a view of an acoustic structure 20C according to a third embodiment.

FIG. 10 shows an acoustic structure 20C according to a third embodiment. The acoustic structure 20C is also the back chamber in the squawker or the like. In FIG. 10, the same reference numerals as used in FIG. 1B are used to identify the corresponding components. As shown in FIG. 10, the acoustic structure 20C has the narrowed portion 220 at the position of the node of the first-order resonance frequency generated in an inner cavity of the acoustic structure 20C in an instance where the narrowed portion 220 is not provided, as in the acoustic structure 20A. As apparent from a comparison between FIG. 10 and FIG. 1B, the acoustic structure 20C differs from the acoustic structure 20A in that the acoustic structure 20C includes: open tubes 21, 22 each of which communicates with the inner cavity of the acoustic structure 20C via first and second open ends of the open tubes 21, 22; and sound absorbers 23*a*-23*f*.

The open tube 21 and the open tube 22 has the same tube length that is equal to an integral multiple of a substantially half wavelength of the first-order standing wave. A first open end 21*a* of the open tube 21 is located substantially at the position of the antinode of the standing wave, and a second open end 21*b* of the open tube 21 is located substantially at the position of the node of the standing wave. In the open tube 21, the sound absorber 23*a* is disposed so as to fill at least a part of the space in the open tube 21. Similarly, a first open end 22*a* of the open tube 22 is located substantially at the position of the antinode of the standing wave, and a second open end 22*b* of the open tube 22 is located substantially at the position of the node of the standing wave. In the open tube 22, the sound absorber 23*b* is disposed so as to fill at least a part of the space in the open tube 22. The open tubes 21, 22 are provided for the following reasons.

JP-2014-175807A describes the following. In a tubular acoustic structure having a cavity in which sound waves propagate, there are provided open tubes each communicating with the cavity via first and second open ends of the open tube and each having a tube length equal to an integral multiple of a half wavelength of a standing wave generated in the cavity. In each open tube, the first open end is located substantially at a position of an antinode of the standing wave, and the second open end is located substantially at a position of a node of the standing wave. JP-2014-175807A describes that this arrangement mitigates peaks and dips that appear in frequency characteristics of the acoustic structure arising from the standing wave. In the present third embodiment, the open tubes 21, 22 are provided in the acoustic structure 20C for enhancing the effect of mitigating the peaks and the dips by combining the effect of provision of the narrowed portion 220 and the effect of provision of the open tubes 21, 22 (described in JP-2014-175807A). Further, the sound absorbers 23*a*, 23*b* are disposed respectively in the open tubes 21, 22 for further enhancing the effect of provision of the open tubes 21, 22.

Figure 11:
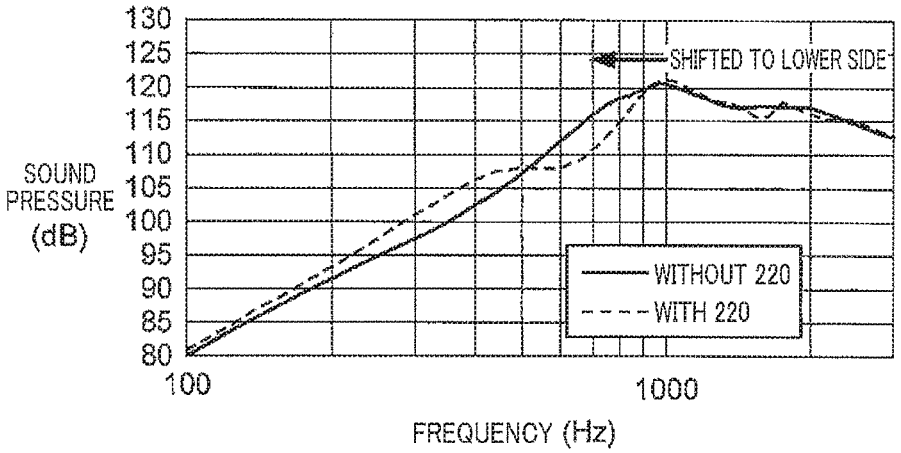
FIG. 11 is a view showing simulation results for frequency characteristics of the acoustic structure 20C.

FIG. 11 shows simulation results of the frequency characteristics of the acoustic structure 20C in a case where the acoustic structure 20C does not have the narrowed portion 220 (i.e., the acoustic structure shaped like a straight tube has the open tubes 21, 22 and the sound absorbers 23*a*-23*f*) and in a case where the acoustic structure 20C has the narrowed portion 220 (i.e., the acoustic structure having the narrowed portion 220 has the open tubes 21, 22 and the sound absorbers 23*a*-23*f*). As apparent from FIG. 11, the first-order resonance frequency is shifted toward the low frequency side by providing the narrowed portion 220, as compared with the case in which the narrowed portion 220 is not provided. In this embodiment, the sound absorbers 23*a*, 23*b* are disposed in the respective open tubes 21, 22 for further enhancing the effect of mitigating the peaks and the dips attained by the open tubes 21, 22. The sound absorber may be disposed in only one of the open tubes 21 and 22 so as to fill at least a part of the space therein. The sound absorber may be omitted. Similarly, any of or all of the sound absorbers 23*c*-23*f* may be omitted.

Fourth Embodiment

Figure 12A:
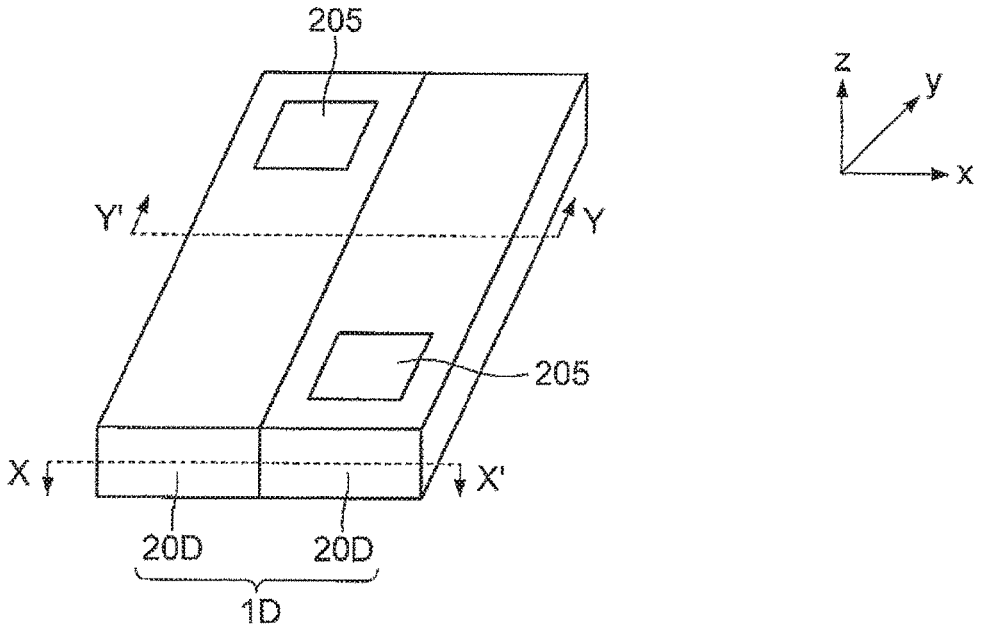
FIGS. 12A-12C are views of an acoustic structure 20D according to a fourth embodiment and an acoustic apparatus 1D including the acoustic structures 20D.
Figure 12B:
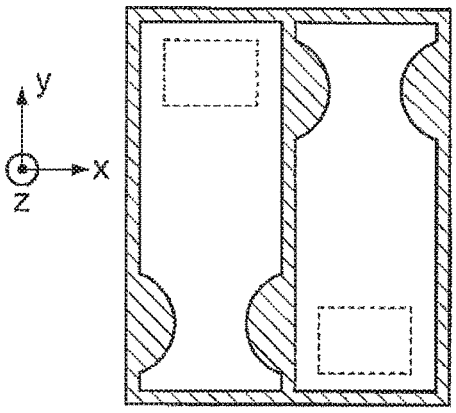
Figure 12C:
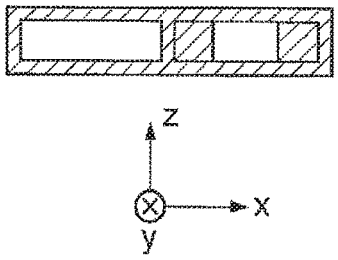

FIG. 12 shows an acoustic apparatus 1D including acoustic structures 20D according to a fourth embodiment. Specifically, FIG. 12A is a perspective view of the acoustic apparatus 1D, FIG. 12B is a cross-sectional view of the acoustic apparatus 1D taken along the line XX' in FIG. 12A, namely, FIG. 12B shows a cross section on a plane including the line XX' and perpendicular to a z-axis, and FIG. 12C is a cross-sectional view taken along the line YY' in FIG. 12A, namely, FIG. 12C shows a cross section on a plane including the line YY' and perpendicular to a y-axis. The acoustic apparatus 1D is an acoustic panel constituted by a plurality of acoustic structures 20D (two acoustic structures 20D in this embodiment) each having a hollow square columnar shape and an opening 205 formed in its side surface. The two acoustic structures 20D are arranged alongside such that the openings 205 of the respective two acoustic structures 20D are oriented toward the same direction (e.g., in the z-axis direction in this embodiment).

In FIG. 12B, the positions of the openings 205 are indicated by the dotted line. Each acoustic structure 20D functions as a one-end closed tube in which the opening 205 corresponds to an open end. As apparent from FIGS. 12B and 12C, the inner wall of each acoustic structure 20D protrudes at a position in the vicinity of a closed end corresponding to the position of the open end, namely, at the position of the antinode of the first-order standing wave generated in the cavity of the acoustic structure 20D. This protruded portion functions as the narrowed portion 220. Consequently, the first-order resonance frequency in the acoustic structure 20D is shifted toward the high frequency side, as compared with a case in which the protruded portion (i.e., the narrowed portion 220) is not provided.

Also in this embodiment, the disturbance in the frequency characteristics arising from the standing wave having a specific frequency is mitigated while preventing the frequency characteristics from being influenced over all frequency ranges of the acoustic apparatus 1D having the acoustic structures 20D. Moreover, this embodiment does not additionally require sound absorbers or the like, avoiding an increase in the manufacture cost of the acoustic structures 20D or the acoustic apparatus 1D including the acoustic structures 20D. In the acoustic apparatus 1D of this embodiment, the plurality of acoustic structures 20D are arranged such that the openings 205 thereof are oriented toward the same direction. The openings 205 of the acoustic structures 20D of the acoustic apparatus 1 need not be oriented toward the same direction.

Other Embodiments

It is to be understood that the illustrated embodiments may be modified as follows.

Figure 13A:
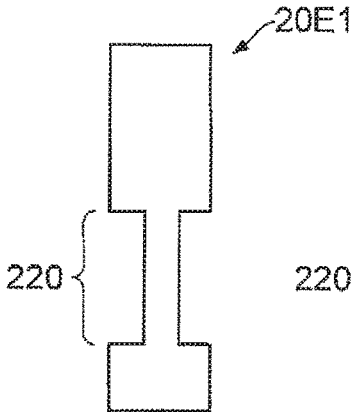
FIGS. 13A-13C are views for explaining a modified embodiment (1)
Figure 13B:
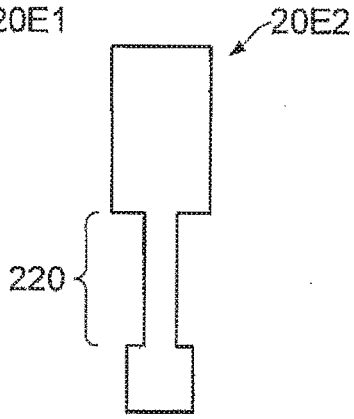
Figure 13C:
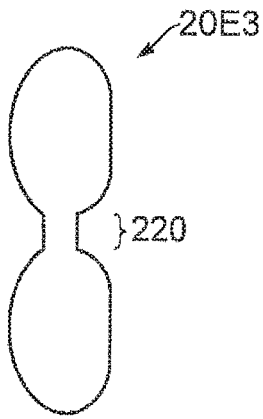

(1) In the first embodiment, the spaces communicating with each other via the narrowed portion 220 are identical in shape and volume. The spaces may be different in shape and volume as shown in an acoustic structure 20E1 of FIG. 13A and an acoustic structure 20E2 of FIG. 13B. Even in these arrangements, the resonance frequency is shifted by the change to the Helmholtz resonance. The resonance frequency as a result of the change to the Helmholtz resonance is calculated by regarding the acoustic structure as a spring-mass system in which the spaces communicating with each other via the narrowed portion 220 correspond to springs and the air in the narrowed portion 220 corresponds to a mass. The shape of the spaces communicating with each other via the narrowed portion 220 is not limited to the cylindrical shape, but may be an elliptical shape as shown in an acoustic structure 20E3 of FIG. 13C.

Figure 14A:
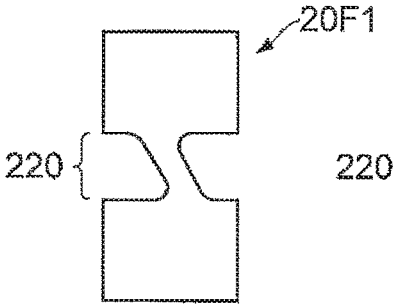
FIGS. 14A-14F are views for explaining a modified embodiment (2)
Figure 14B:
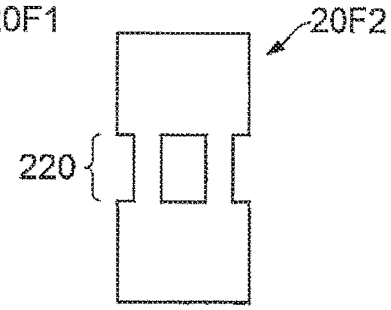
Figure 14C:
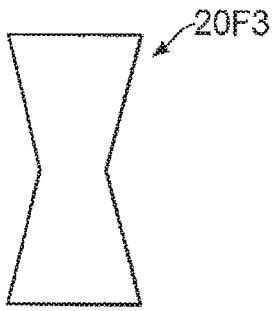
Figure 14D:
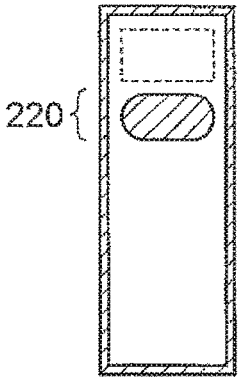
Figure 14E:
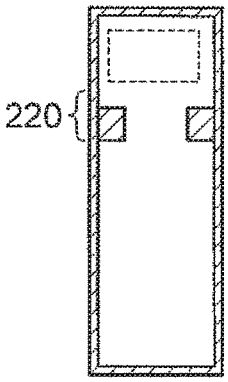
Figure 14F:
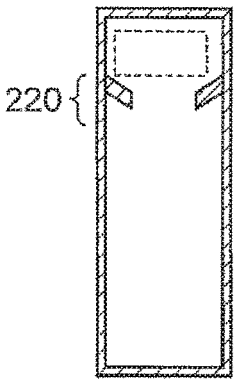

(2) The narrowed portion 220 in each of the first through third embodiments may be modified as shown in FIGS. 14A-14C. In an acoustic structure 20F1 shown in FIG. 14A, the narrowed portion 220 has a cylindrical shape inclined with respect to the tube axis direction. In an acoustic structure 20F2 shown in FIG. 14B, the narrowed portion 220 is constituted by a plurality of circular cylinders each having a small cross-sectional area. An acoustic structure 20F3 shown in FIG. 14C is constructed such that the cross-sectional area of the tube gradually decreases from opposite ends of the tube toward the position of the node of the first-order standing wave. The narrowed portion 220 in the fourth embodiment may be modified as shown in FIGS. 14D-14F in which the position of the opening 205 is indicated by the dotted line. In FIGS. 14D-14F, the narrowed portion 220 is provided in the vicinity of the opening 205 of the acoustic structure of the acoustic panel, namely, at the position of the node of the first-order standing wave. It is noted that, in the acoustic structure of each of the first through third embodiments, the narrowed portion 220 may be formed by providing a protrusion shown in FIGS. 14D-14F. These acoustic structures may be formed as follows, for instance. Two separate members to be obtained by dividing the acoustic structure on the plane including the tube axis are formed by injection molding of resin or the like and are bonded to each other. For shifting the resonance frequency by providing the narrowed portion, the narrowed portion 220 may have any shape and may be formed by any method as long as the cross-sectional area of the cavity is smaller at the position corresponding to the narrowed portion 220 than at the other position.

(3) In the illustrated embodiments, the resonance frequency corresponding to the standing wave generated in the inner cavity of the tubular acoustic structure is shifted toward the low frequency side by providing the narrowed portion at the position of the node of the standing wave, namely, by reducing the cross-sectional area of the cavity at the position of the node smaller, as compared with the cross-sectional area at the other position. In an instance where the resonance frequency to be shifted toward the low frequency side is an even-numbered order resonance frequency, the similar advantage is ensured by increasing the cross-sectional area of the cavity at the position of the antinode of the standing wave corresponding to the resonance frequency, as compared with the other position.

Figure 15A:
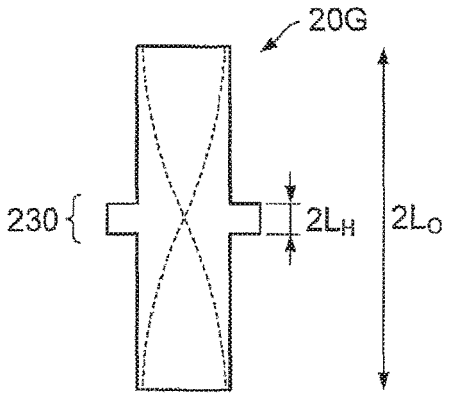
FIGS. 15A and 15B are views for explaining a modified embodiment (3)
Figure 15B:
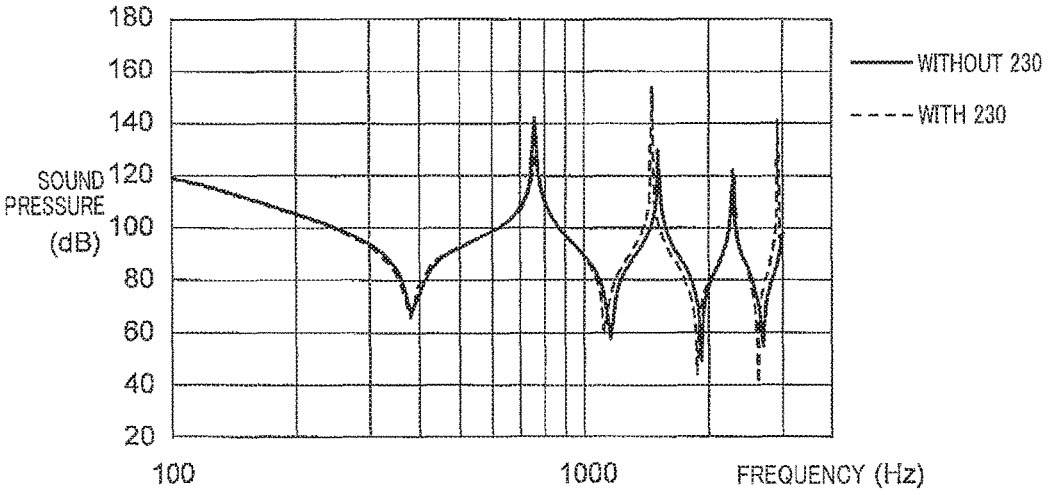

FIG. 15A shows an acoustic structure 20G in the form of a both-end closed tube having a protruding portion 230 which is provided at the position of the antinode of the second-order standing wave, namely, at the position of the node of the first-order standing wave. The cross-sectional area of the cavity of the acoustic structure 20G is larger at the protruding portion 230 than at the other position. FIG. 15B shows simulation results for the frequency characteristics of the acoustic structure 20G. As apparent from FIG. 15B, by providing the protruding portion 230 at the position indicated above, the second-order resonance frequency is slightly shifted toward the low frequency side whereas the first-order resonance frequency is hardly shifted. The simulation results in the illustrated embodiments and this modified embodiment are summarized as follows. In the tubular acoustic structure having the cavity in which the sound wave propagates, the resonance frequency corresponding to the standing wave can be shifted toward the low frequency side to a large extent by reducing the cross-sectional area of the cavity at the position substantially corresponding to the node of the standing wave generated in the cavity, as compared with the cross-sectional area at the other position. The cross-sectional area is on the plane intersecting the propagation path of the sound wave. In the acoustic structure, the resonance frequency corresponding to the standing wave can be shifted toward the high frequency side by a small extent by reducing the cross-sectional area, on the plane, of the cavity at the position substantially corresponding to the antinode of the standing wave generated in the cavity, as compared with the cross-sectional area at the other position. On the contrary, the resonance frequency can be shifted toward the low frequency side by a small extent by increasing the cross-sectional area, on the plane, of the cavity at the position substantially corresponding to the antinode of the standing wave, as compared with the cross-sectional area at the other position.

In the illustrated embodiments, the principle of the invention is applied to the tubular acoustic structure. The principle of the invention is applicable to a box-shaped acoustic structure such as a speaker enclosure, other than the tubular acoustic structure. In short, as long as the acoustic structure has the cavity in which the sound wave propagates, namely, as long as the acoustic structure has a space defined by the wall surface that constitutes the acoustic structure, and as long as the sound wave generated by a vibration of a vibrating member or the like propagates in the cavity of the acoustic structure, the resonance frequency corresponding to the standing wave can be shifted by forming the acoustic structure such that the cross-sectional shape of the cavity on the plane orthogonal to the propagation direction of the sound wave is made different between: the position of the cavity substantially corresponding to the position of the node or the antinode of the standing wave; and the other position of the cavity. In the illustrated embodiments, the resonance frequency corresponding to the standing wave generated in the tube axis direction of the tubular acoustic structure is shifted. The resonance frequency corresponding to the standing wave generated in the other direction, e.g., a direction orthogonal to the tube axis, can be shifted by forming the acoustic structure such that the cross-sectional area of the cavity is made different between: the position of the cavity substantially corresponding to the position of the node or the antinode of the standing wave; and the other position of the cavity. In short, it is at least required that the cross-sectional area of the cavity on the plane orthogonal to the propagation direction of the sound wave that generates the standing wave to be controlled is made different between: the position of the cavity substantially corresponding to the position of the node or the antinode of the standing wave; and the other position of the cavity.

Figure 16:
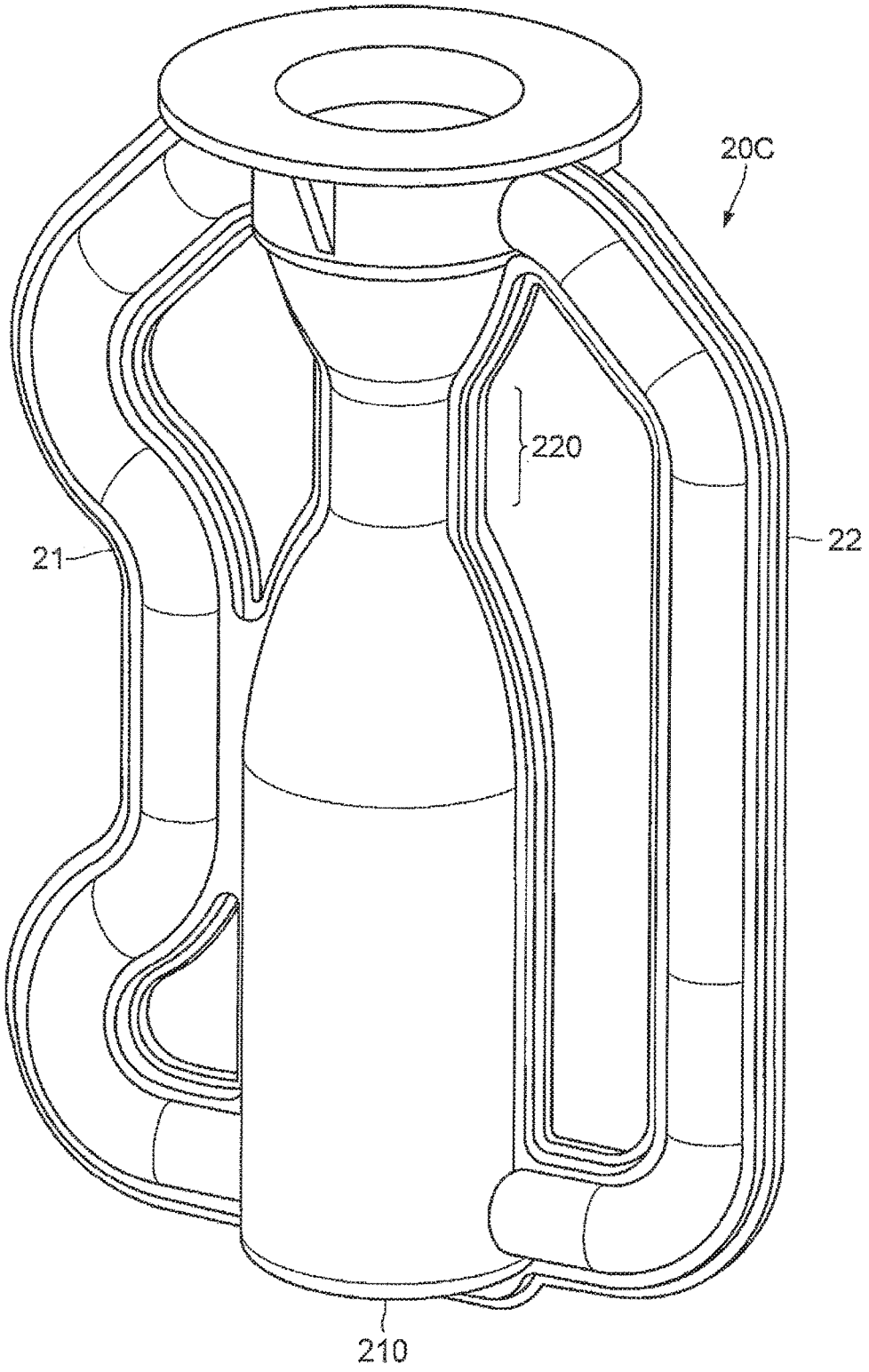
FIG. 16 is a view for explaining a modified embodiment (4)

(4) In the illustrated third embodiment, the acoustic structure 20C includes the open tubes 21, 22 communicating with the inner cavity of the acoustic structure 20C via the first and second open ends of the open tubes 21, 22. The acoustic structure 20C may include only one open tube or may include three or more open tubes. In the illustrated third embodiment, the open tube 21 and the open tube 22 have mutually the same tube length. The open tube 21 and the open tube 22 may have mutually different tube lengths, as shown in FIG. 16. That is, in an instance where the acoustic structure 20C includes a plurality of open tubes, the open tubes may have mutually different tube lengths, but each of the tube lengths is equal to an integral multiple of substantially a half wavelength of the standing wave generated in the cavity. At least two of the plurality of open tubes may have mutually the same tube length. In an instance where all of the plurality of open tubes of the acoustic structure 20C have mutually the same tube length, it is possible to further enhance the effect of mitigating the peaks and the dips that appear in the frequency characteristics of the acoustic structure 20C due to the standing wave having a frequency corresponding to the tube length of the open tubes. In an instance where the open tubes of the acoustic structure 20C have mutually different tube lengths, it is possible to mitigate the peaks and the dips due to the standing waves having various frequencies corresponding to different tube lengths of the open tubes.

Figure 17:
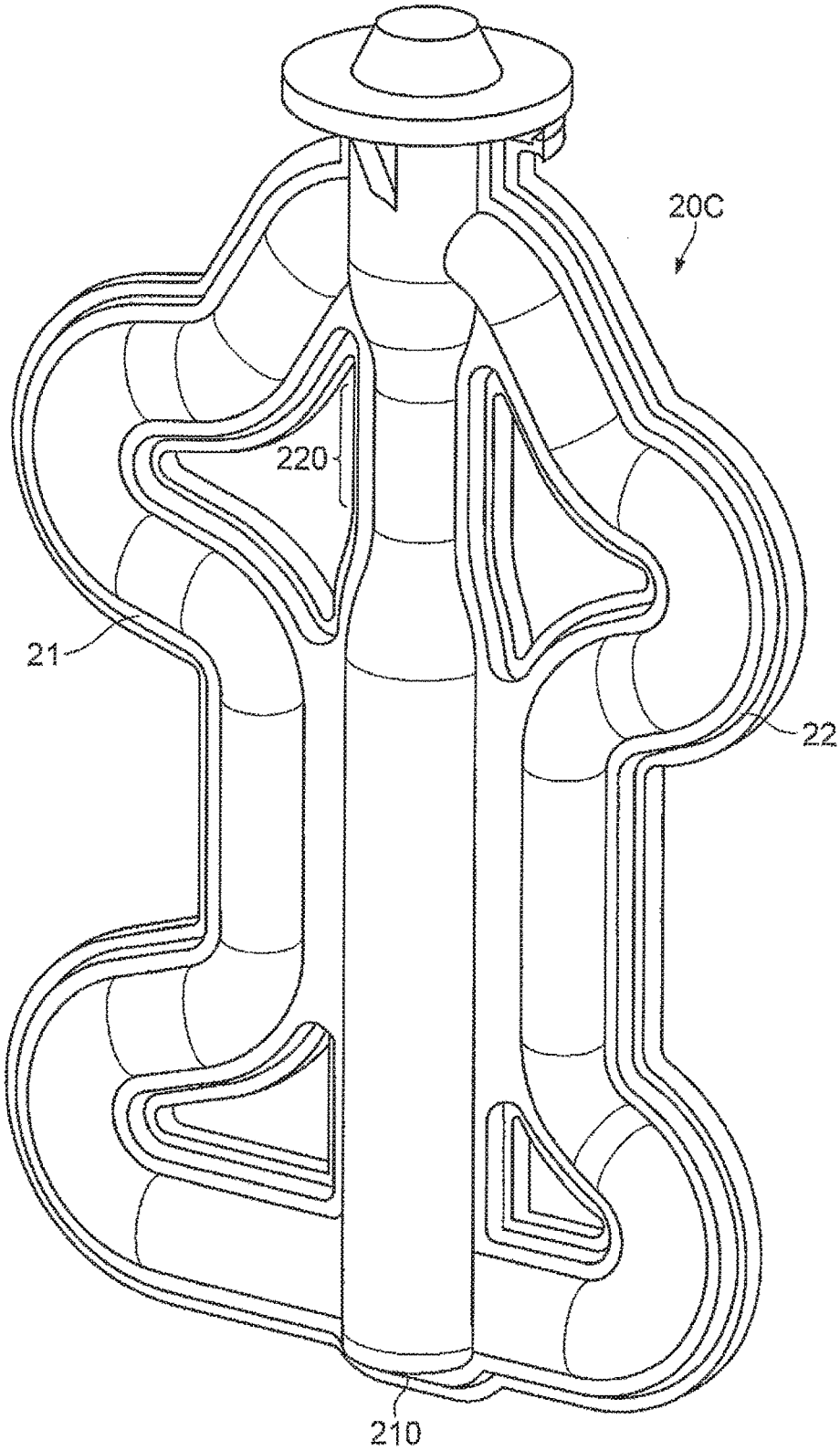
FIG. 17 is a view for explaining a modified embodiment (5)

(5) In the illustrated third embodiment, each of the open tubes 21, 22 is bent twice, as shown in FIG. 10. At least one of the open tube 21 and the open tube 22 may be bent three or more times or may be bent only once. In an acoustic structure 20C shown in FIG. 17, each of the open tubes 21, 22 is bent five times. In an instance where the open tubes 21, 22 are bent at least once, the acoustic structure is compact in size, so that the acoustic structure can be hosed in the acoustic apparatus with high efficiency. The open tubes 21 and the open tube 22 may be bent mutually the same or different number of times.

The open tubes 21, 22 need not be necessarily bent. In this case, the open tubes 21, 22 communicate with the inner cavity via only one of the first open end and the second open end of the open tubes 21, 22. Also in this case, it is possible to mitigate the peaks and the dips that appear in the frequency characteristics of the acoustic structure 20C arising from the standing wave generated in the inner cavity. Only one of the open tube 21 and the open tube 22 may communicate with the inner cavity via only one of the first open end or the second open end.

Figure 18A:
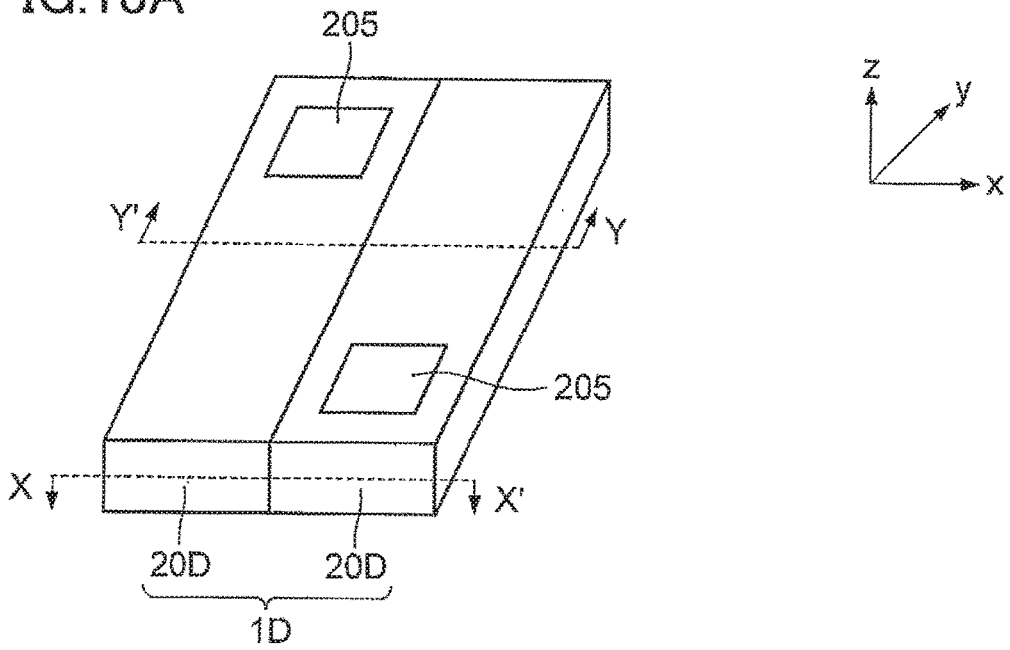
FIGS. 18A-18C are views for explaining a modified embodiment (6)
Figure 18B:
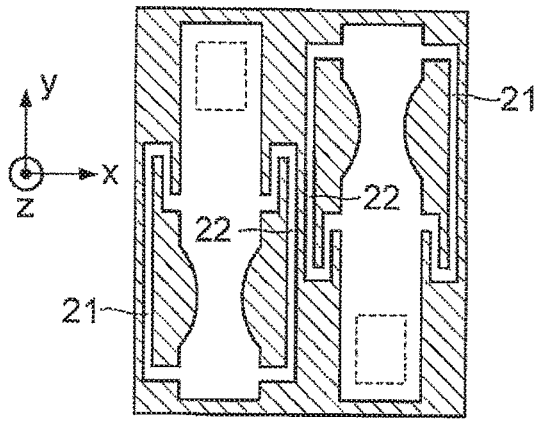
Figure 18C:
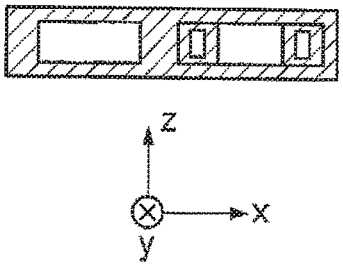
Figure 19A:
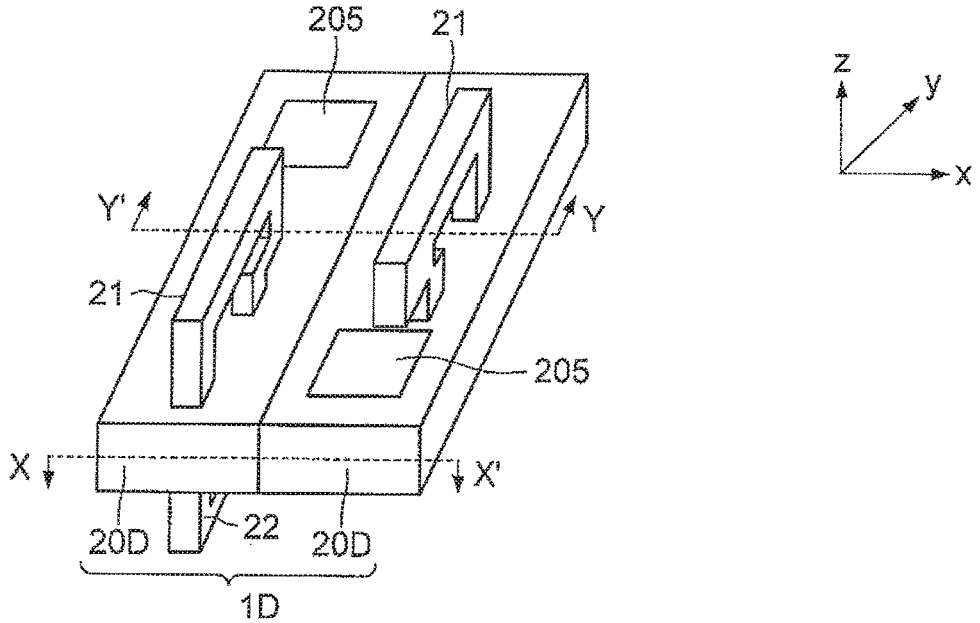
FIGS. 19A-19C are views for explaining the modified embodiment (6).
Figure 19B:
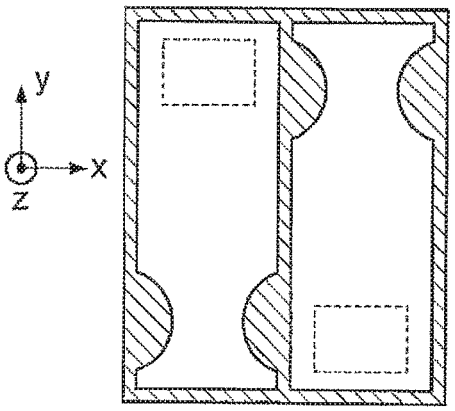
Figure 19C:
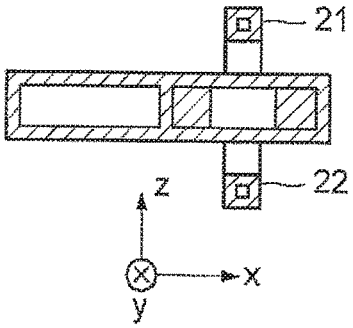

(6) The illustrated third embodiment may be combined with the illustrated second embodiment or the illustrated fourth embodiment. In an arrangement in which the third embodiment and the fourth embodiment are combined, the open tubes 21, 22 may be embedded in the wall surface of the acoustic structure 20D as shown in FIGS. 18A-18C or the open tubes 21, 22 may be disposed as shown in FIGS. 19A-19C.

What is claimed is:

1. An acoustic structure defining a cavity in which a sound wave propagates, wherein a first portion of the cavity substantially corresponding to a position of a node of a standing wave generated in the cavity has an area different from an area of a second portion of the cavity except the first portion, the areas being on a plane orthogonal to a direction of propagation of the sound wave, wherein the area, on the plane, of the first portion of the cavity substantially corresponding to the position of the node of the standing wave is smaller than the area of the second portion of the cavity on the plane, and wherein the first portion is an intermediate portion of the cavity located intermediate between an open end that is connected to a backside of a speaker and a closed end of the acoustic structure.

2. The acoustic structure according to claim 1, which is shaped like a tube, wherein the plane orthogonal to the direction of propagation of the sound wave is a plane orthogonal to a direction in which an axis of the tube extends.

3. The acoustic structure according to claim 1, comprising an open tube communicating with the cavity via open ends of the open tube, wherein the open tube has a tube length equal to an integral multiple of substantially a half wavelength of the standing wave, and the open ends of the open tube are located at at least one of a portion of the cavity substantially corresponding to a position of an antinode of the standing wave and a portion of the cavity substantially corresponding to a position of a node of the standing wave.

4. The acoustic structure according to claim 3, comprising a plurality of the open tubes, wherein the plurality of tubes have mutually different tube lengths.

5. The acoustic structure according to claim 3, comprising at least one sound absorber that fills at least a part of at least one of: a space in the open tube and a space in the cavity.

6. The acoustic structure according to claim 3, wherein the open tube is bent at least once.

7. The acoustic structure according to claim 1, wherein the area, on the plane, of the first portion of the cavity substantially corresponding to the position of the node of the standing wave is a first area, and the area of the second portion of the cavity on the plane is a second area, wherein the first area is smaller than the second area.

8. The acoustic structure according to claim 7, wherein the standing wave is a first-order standing wave generated in the cavity, and wherein the area, on the plane, of the first portion of the cavity substantially corresponding to the position of the node of the first-order standing wave is the first area, and the area of the second portion of the cavity except the first portion on the plane is the second area.

9. The acoustic structure according to claim 7, wherein the standing wave includes a first-order standing wave and a second-order standing wave generated in the cavity, and wherein the area, on the plane, of the first portion of the cavity substantially corresponding to the position of the node of each of the first-order standing wave and the second-order standing wave is the first area, and the area of the second portion of the cavity except the first portion on the plane is the second area.

10. The acoustic structure according to claim 7, wherein the standing wave is a second-order standing wave generated in the cavity, and wherein the area, on the plane, of the first portion of the cavity substantially corresponding to the position of the node of the second-order standing wave is the first area, and the area of the second portion of the cavity except the first portion on the plane is the second area.

11. The acoustic structure according to claim 1, wherein an area of the intermediate portion of the cavity on the plane is a first area, and an area, on the plane, of each of two portions ranging from respective opposite end portions of the cavity in the direction of propagation of the sound wave to the intermediate portion is a second area different from the first area.

12. An acoustic structure defining a cavity in which a sound wave propagates, wherein an intermediate portion of the cavity located intermediate between an open end that is connected to a back side of a speaker and a closed end of the acoustic structure has an area different from an area of each of two portions ranging from respective opposite ends portions of the cavity in a direction of propagation of the sound wave to the intermediate portion, the areas being on a plane orthogonal to the direction of propagation of the sound wave, and wherein the area, on the plane, of the intermediate portion of the cavity substantially corresponding to a position of a node of a standing wave is smaller than the area of each of the two portions ranging from the respective opposite ends portions of the cavity on the plane.

13. The acoustic structure according to claim 12, wherein an area of the intermediate portion of the cavity on the plane is a first area, and an area of each of two portions ranging from the respective opposite end portions to the intermediate portion is a second area different from the first area.

14. The acoustic structure according to claim 12, comprising an open tube communicating with the cavity via open ends of the open tube, wherein the open tube has a tube length equal to an integral multiple of substantially a half wavelength of the standing wave, and the open ends of the open tube are located at at least one of a portion of the cavity substantially corresponding to a position of an antinode of the standing wave and a portion of the cavity substantially corresponding to a position of a node of the standing wave.

15. An acoustic panel, comprising a plurality of acoustic structures arranged alongside with each other, wherein each of the acoustic structures defines a cavity in which a sound wave propagates, wherein, for each of the acoustic structures, an area of an intermediate portion of its cavity located intermediate between an open end and a closed end of the acoustic structure is smaller than an area of each of two portions ranging from respective opposite end portions of the cavity in a direction of propagation of the sound wave to the intermediate portion, the areas being on a plane orthogonal to the direction of propagation of the sound wave, wherein, for each of the acoustic structures, the area, on the plane, of the intermediate portion of the cavity substantially corresponding to a position of a node of a standing wave is smaller than the area of each of the two portions ranging from respective opposite end portions of the cavity on the plane, and wherein each of the acoustic structures has, on a side surface thereof, an opening as the open end through which the cavity communicates with an exterior of the acoustic structure.

16. An acoustic apparatus, comprising:

a cabinet; and a speaker mounted on a front surface of the cabinet and including (a) a driver configured to generate an acoustic vibration based on audio signals and (b) an acoustic structure having a first end that is open toward a backside of the driver and a second end that is closed, wherein the acoustic structure defines a cavity in which a sound wave propagates, and wherein a first portion of the cavity substantially corresponding to a position of a node a standing wave generated in the cavity has an area different from an area of a second portion of the cavity except the first portion, the areas being on a plane orthogonal to a direction of propagation of the sound wave, wherein the area, on the plane, of the first portion of the cavity substantially corresponding to the position of the node of the standing wave is smaller than the area of the second portion of the cavity on the plane, and wherein the first portion is an intermediate portion of the cavity located intermediate between the first end and the second end.

* * * * *